US006644045B1

(12) United States Patent
Tang et al.

(10) Patent No.: US 6,644,045 B1
(45) Date of Patent: Nov. 11, 2003

(54) OIL FREE SCREW EXPANDER-COMPRESSOR

(75) Inventors: Yan Tang, Daphne, AL (US); Joost J. Brasz, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/179,568

(22) Filed: Jun. 25, 2002

(51) Int. Cl.[7] ..... F25B 1/00; F25D 9/00

(52) U.S. Cl. ..... 62/116; 62/402; 62/174; 62/468; 62/470; 62/473

(58) Field of Search ..... 62/174, 116, 468, 62/402, 470, 473

(56) References Cited

U.S. PATENT DOCUMENTS

| | | | | | |
|---|---|---|---|---|---|
| 4,497,185 | A | * | 2/1985 | Shaw | 62/468 |
| 4,913,634 | A | * | 4/1990 | Nagata et al. | 418/47 |
| 5,211,026 | A | * | 5/1993 | Linnert | 62/175 |
| 5,653,585 | A | * | 8/1997 | Fresco | 418/100 |
| 5,832,737 | A | * | 11/1998 | Moilanen | 62/228.5 |
| 5,911,743 | A | * | 6/1999 | Shaw | 62/84 |
| 6,003,324 | A | * | 12/1999 | Shaw | 62/201 |
| 6,467,287 | B2 | * | 10/2002 | Sjoholm et al. | 62/193 |

* cited by examiner

*Primary Examiner*—Timothy L. Maust
*Assistant Examiner*—Mark Shulman

(57) ABSTRACT

The expansion device in a refrigeration or air conditioning system is an expressor. The expresser is made up of a twin screw expander and a twin screw compressor with rotors of the expander functioning as timing gears.

8 Claims, 3 Drawing Sheets

OIL FREE SCREW EXPANDER-COMPRESSOR

BACKGROUND OF THE INVENTION

All closed refrigeration systems serially include a compressor, a condenser, an expansion device and an evaporator. Expansion devices include fixed orifices, capillaries, thermal and electronic expansion valves, turbines, and expander-compressors or expressors. In each of the expansion devices, high pressure liquid refrigerant is flashed as it goes through a pressure drop with at least some of the liquid refrigerant becoming a vapor causing an increase in specific volume. In an expressor, the volumetric increase is used to power a companion compressor which delivers high pressure refrigerant vapor to the discharge of the system compressor thereby increasing system capacity. Since the compression process occurring in the expressor is not powered by an electric motor, but by the flashing liquid refrigerant, overall refrigeration efficiency increases by the same amount as the system capacity.

Screw compressors and expanders are fundamentally unbalanced both axially and radially. Three-port screw expressors with a single low pressure port, as exemplified by commonly assigned U.S. Pat. No. 6,185,956, are still radially unbalanced.

SUMMARY OF THE INVENTION

An oil free screw expander-compressor, or expressor, unit is used for phase changing air conditioning and refrigeration systems. The expander functions as a set of timing gears in controlling the relative angular positions of the male and female rotors and driving the companion compressor of the expresser. This is possible since the expander has a liquid refrigerant component of at least 70% which forms a strong dynamic liquid film to separate the male and female rotors. The refrigerant-lubricated expander rotors become a pair of timing gears just like conventional timing gears in a dry screw compressor. The male and female rotors of the compressor portion of the expressor are given a greater clearance and therefore do not contact each other. This characteristic allows oil-free, dry compressor operation for the compressor portion of the expressor, just like a timing gear allows oil-free operation of conventional compressors. The difference between the timing gears of conventional dry compressors and the two phase flow screw expander in the expressor is that the former is a conventional gear transferring torque from a mechanical drive while the latter is itself an expander. The rotors of the expander and compressor of the expressor are oil-free with the expander rotors being lubricated by the liquid portion of the two-phase working fluid, and a dynamic liquid film separates the male and female rotors of the expander.

It is an object of this invention to balance radial and axial gas forces in an expressor.

It is an additional object of this invention to limit rotor distortion thereby allowing reduction of the clearance between the expressor rotors.

It is another object of this invention to reduce bearing loading in an expresser.

It is a further object of this invention to improve expressor performance.

It is an additional object of this invention to use the rotors of the expander as timing gears relative to the rotors of the compressor of the expressor. These objects, and others as will become apparent hereinafter, are accomplished by the present invention.

Basically, the expansion device in a refrigeration or air conditioning system is an expressor. The expressor is made up of a twin screw expander and a twin screw compressor with rotors of the expander functioning as timing gears.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
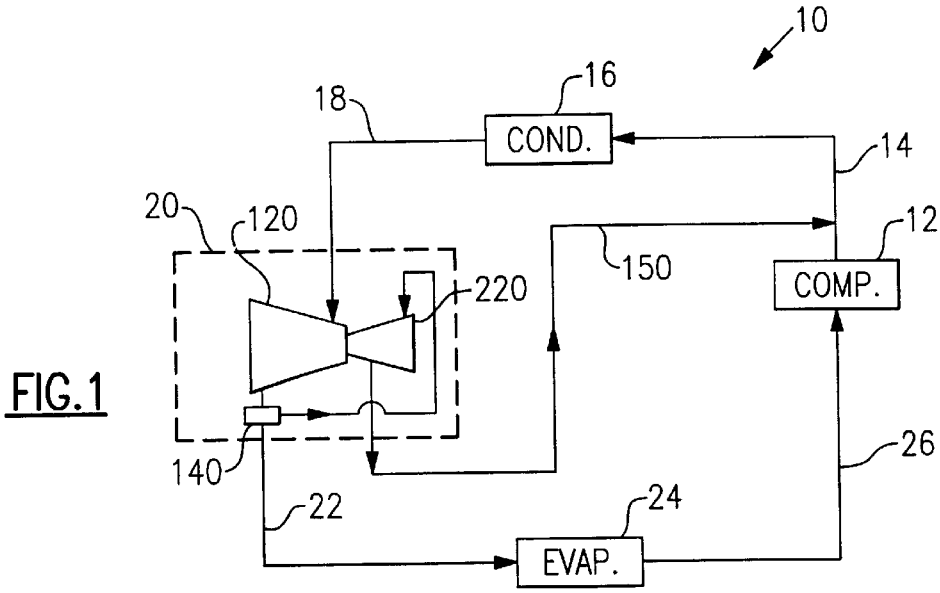
FIG. 1 is a schematic representation of a refrigeration or air conditioning system employing the present invention.
Figure 2:
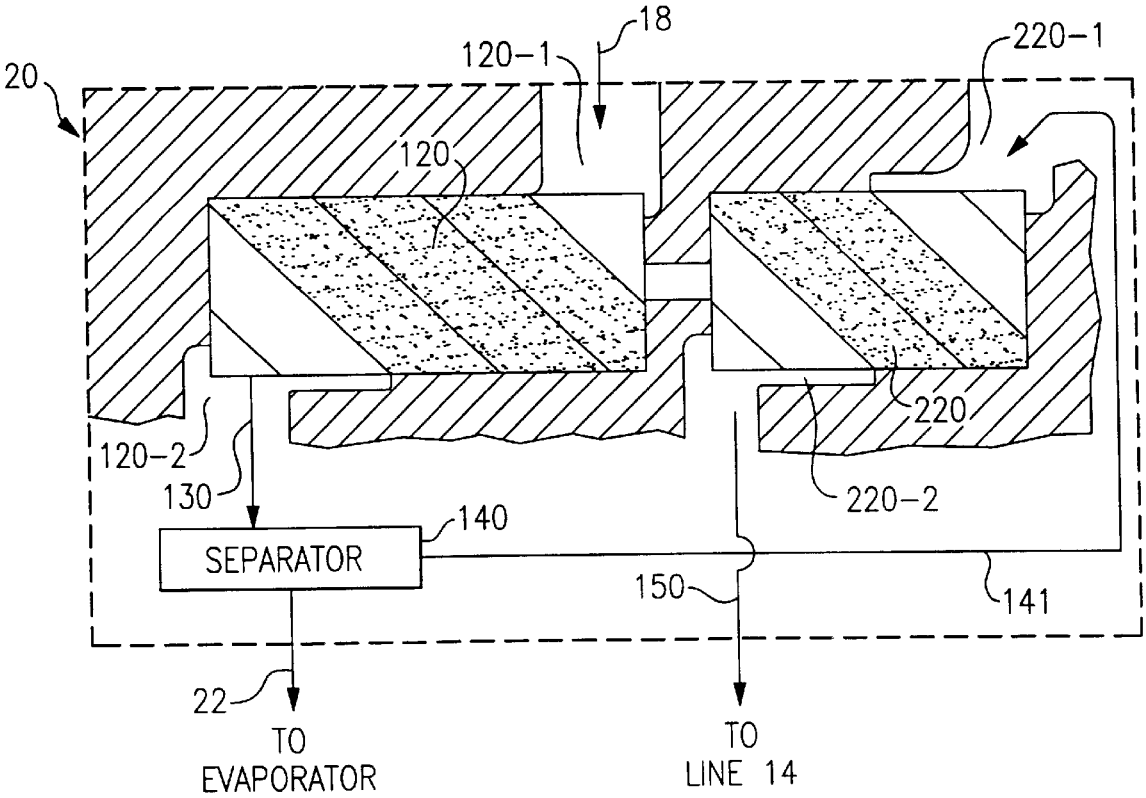
FIG. 2 is a simplified representation of the expressor of the FIG. 1 system.
Figure 3:
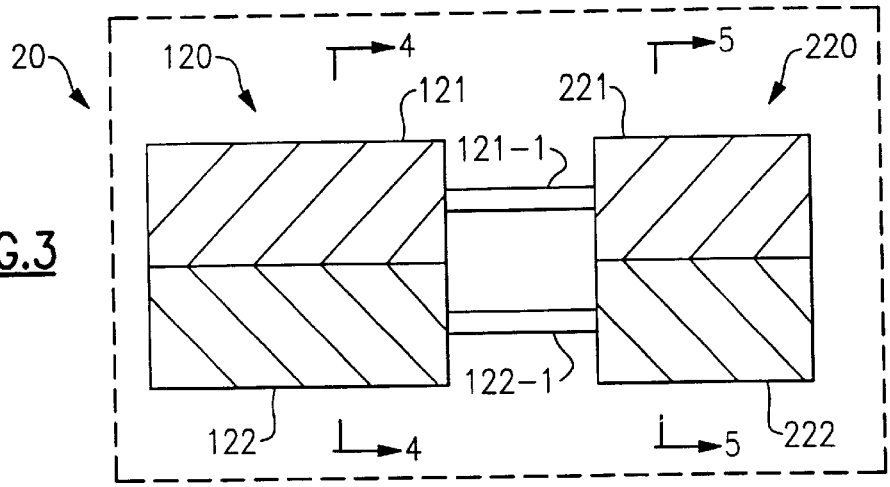
FIG. 3 is a simplified view taken parallel to the axes of the rotors of the expressor of FIG. 2.
Figure 4:
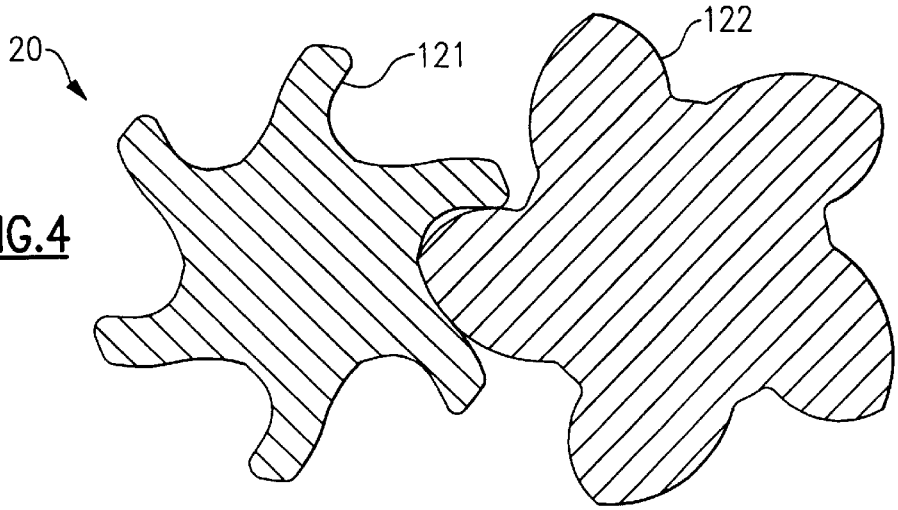
FIG. 4 is a sectional view of the expander section of the expresser taken along line 4—4 of FIG. 3.
Figure 5:
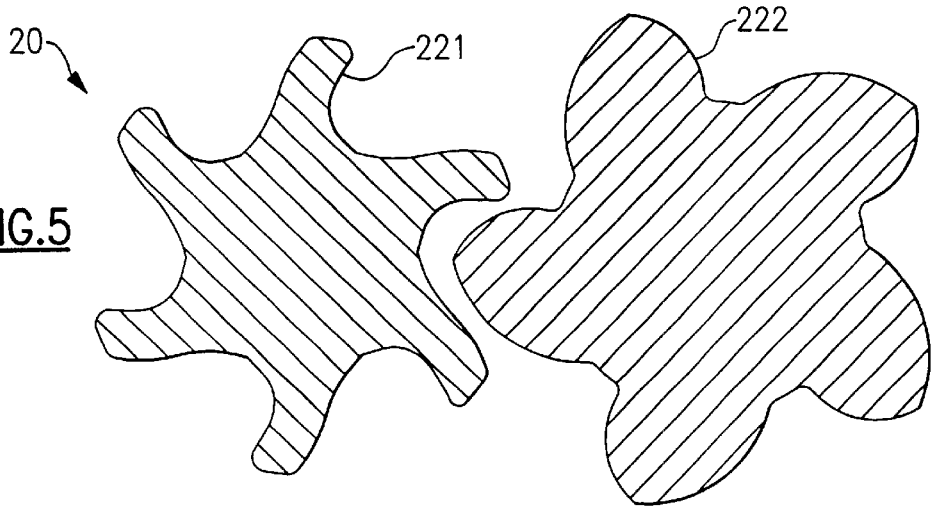
FIG. 5 is a sectional view of the compressor section of the expressor taken along line 5—5 of FIG. 3.

In FIG. 1, the numeral 10 generally indicates a refrigeration or air conditioning system. Starting with compressor 12, the system 10 serially includes discharge line 14, condenser 16, line 18, an expansion device in the form of expressor 20, line 22, evaporator 24 and suction line 26 completing the circuit. Referring to FIGS. 2–5, the expressor 20 includes two pairs of screw rotors with each rotor of each pair being on a common shaft with a rotor of the other pair. Taking FIGS. 1 and 2 together, it will be noted that high pressure liquid refrigerant from condenser 16 is supplied via line 18 to inlet 120-1 of expander 120 of expressor 20. As best shown in FIGS. 3 and 4, expander 120 has a pair of screw rotors 121 and 122. The high pressure liquid refrigerant supplied to inlet 120-1 of expander 120 causes rotors 121 and 122 to rotate. As rotors 121 and 122 rotate they coact as an expander which drops the pressure of the trapped volumes of refrigerant causing them to flash. Since the phase change from liquid to gas requires an energy transfer, a portion of the liquid refrigerant flashes. Typically, 15% of the liquid refrigerant flashes, but up to 30% is possible under the proper conditions. The low pressure mixture of gaseous and liquid refrigerant at, nominally, evaporator pressure passes from expander discharge 120-2 passing via line 130 into separator 140.

Separator 140 may be located within expressor 20, as illustrated, or may be external thereto. Separator 140 separates the liquid and vapor phases of the refrigerant and supplies the liquid phase and a portion of the vapor phase to evaporator 24 via line 22. The vapor phase portion of refrigerant supplied via line 141 from separator 140 will be dictated by the specific refrigerant, the cycle, and the system configuration. For example, for refrigerant 134*a* the vapor would be 6% for a water cooled chiller and 10% for an air-cooled chiller. Typically, the vapor would be at least 5%. Assuming refrigerant 134*a* and a water cooled chiller, a portion of the refrigerant, on the order of 6%, in the vapor phase of the separated refrigerant is supplied via line 141 from separator 140 to compressor suction inlet 220-1 of compressor 220. Referring to FIG. 3, the rotation of screw rotor 121 of expander 120 causes the rotation of screw rotor 221 of compressor 220 through common shaft 121-1. Similarly, the rotation of screw rotor 122 of expander 120 causes the rotation of screw rotor 222 of compressor 220 through common shaft 122-1. With rotors 221 and 222 of compressor 220 being driven by rotors 121 and 122, respectively, of expander 120, the low pressure gaseous refrigerant supplied to compressor suction inlet 220-1 is compressed by the coaction of rotors 221 and 222. High pressure refrigerant vapor at, nominally, the discharge pressure of compressor 12 is delivered to compressor discharge 220-2 and passes via line 150 to discharge line 14 where it combines with the high pressure refrigerant gas being supplied by main compressor 12. Accordingly, for the example given, on the order of 106% of the output of compressor 12 is supplied to condenser 16.

As noted above, screw rotor 221 is integral with and rotates as a unit with screw rotor 121 and screw rotor 222 is integral with and rotates as a unit with screw rotor 122. In comparing FIGS. 4 and 5, it will be noted that rotors 121 and 122 of expander 120 are in contact whereas rotors 221 and 222 of compressor 220 have a clearance which is exaggerated in FIG. 5. It follows that screw rotors 221 and 222 do not coact in the oil-flooded screw compressor manner used in the refrigeration industry wherein one screw rotor is in engagement with and drives the other rotor. Accordingly, the coaction of rotors 121 and 122 is that of timing gears relative to screw rotors 221 and 222. Because rotors 221 and 222 do not contact, they do not require lubrication. Because rotors 121 and 122 are being acted on by primarily liquid refrigerant, the liquid refrigerant provides the sealing and lubricating function normally supplied by lubricants. Since rotors 221 and 222 do not touch, the rotor profiles are designed for their sealing function rather than for a driving/driven relationship. Rotors 121 and 122 have a tighter interlobe clearance than rotors 221 and 222. Rotors 121 and 122 are lubricated by the liquid refrigerant in the two-phase working fluid and a dynamic liquid film separates and seals rotors 121 and 122. The rotor profiles for rotors 121, 122, 221 and 222 are designed such that the resultant torque between the pairs of rotors in both expander 120 and compressor 220 are unidirectional. Additionally, the rotor profiles for rotors 121 and 122 of expander 120 have a high relative radius at the drive band in order to minimize the contact stresses between the rotors. Rotors 121, 122, 221 and 222 have reduced distortion compared to conventional screw compressors and expanders or three-port expressor designs such as shown in the prior art which permits the reduction of tip clearance thereby improving performance.

Condenser 16 is nominally at the same pressure as the discharge of compressor 12 which is supplied to condenser 16, via discharge line 14. The discharge pressure of compressor 220 is, nominally, the same as that of compressor 12. Accordingly, the pressure supplied at port 120-1 via line 18 and the pressure at discharge port 220-2 which is supplied via line 150 to discharge line 14 are the same. The pressures at ports 120-1 and 220-2 act in opposite directions on the integral rotors 121 and 221 as well as on integral rotors 122 and 222 and are thereby balanced. The discharge port 120-2 is in fluid communication with inlet port 220-1 via line 130, separator 140 and line 141 and are at, nominally, the same pressure. The pressures at discharge ports 120-2 and at suction port 220-1 act in opposite directions on the integral rotors 121 and 221 as well as on integral rotors 122 and 222 and are thereby balanced. As a consequence the axial loading on the rotors 121 and 221 and rotors 122 and 222 are greatly reduced if not eliminated.

With the suction and discharge ports located as described and illustrated, axial and radial gas forces on expander 120 and compressor 220 of expresser 20 are minimized. Since bearing loading is mainly caused by unbalanced couples, the above described porting reduces the radial and axial bearing loading.

In operation, hot, high pressure refrigerant vapor from compressor 12 is supplied via discharge line 14 to condenser 16 where the refrigerant gas condenses to a liquid which is supplied via line 18 to expressor 20. The high pressure liquid refrigerant is supplied via line 18 to a twin screw expander 120 which causes the refrigerant to flash and reduce in pressure while driving rotors 121 and 122 of expander 120 as well as twin screw rotors 221 and 222 of compressor 220. The low pressure refrigerant vapor/liquid mixture passes from expander 120 to separator 140 which supplies pure vapor via line 141 to the compressor section of expressor 20 and supplies a wetter two-phase flow mixture via line 22 to evaporator 24 where the liquid refrigerant evaporates and the resultant gaseous refrigerant is supplied to compressor 12 via suction line 26 to complete the cycle. The refrigerant vapor from separator 140 is supplied to suction inlet 220-1 of twin screw compressor 220. Rotor 121 of expander 120 is integral with rotor 221 of compressor 220 and moves as a unit therewith. Similarly, rotor 122 of expander 120 is integral with rotor 222 of compressor 220 and moves as a unit therewith. Accordingly, gaseous refrigerant supplied to suction inlet 220-1 is compressed by coacting rotors 221 and 222 and the resultant compressed gaseous refrigerant, at nominally the same pressure as the discharge pressure of compressor 12, is delivered by compressor 220 via discharge port 220-2 and line 150 to line 14 where it effectively increases the amount of hot, high pressure refrigerant delivered to condenser 16 and thereby increases the capacity of system 10.

Figure 6:
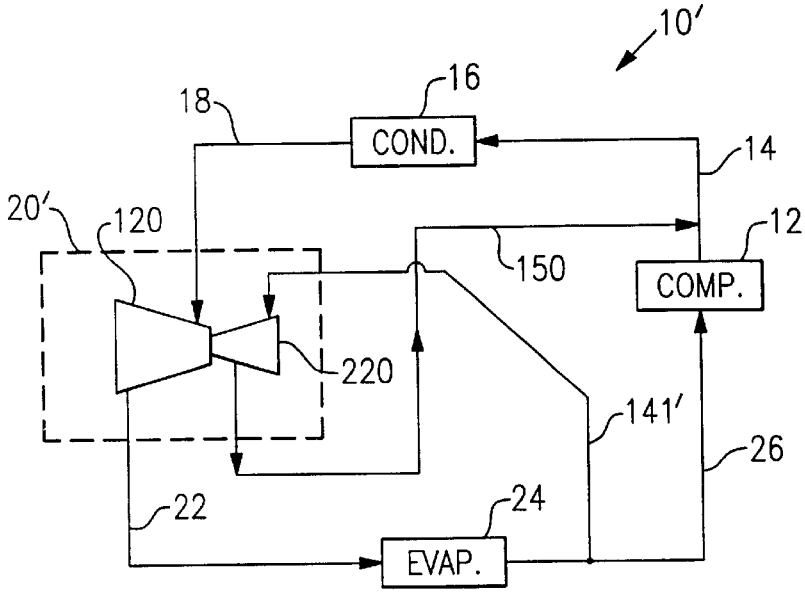
FIG. 6 is a schematic representation of a refrigeration or air conditioning system employing a modification of the present invention.
Figure 7:
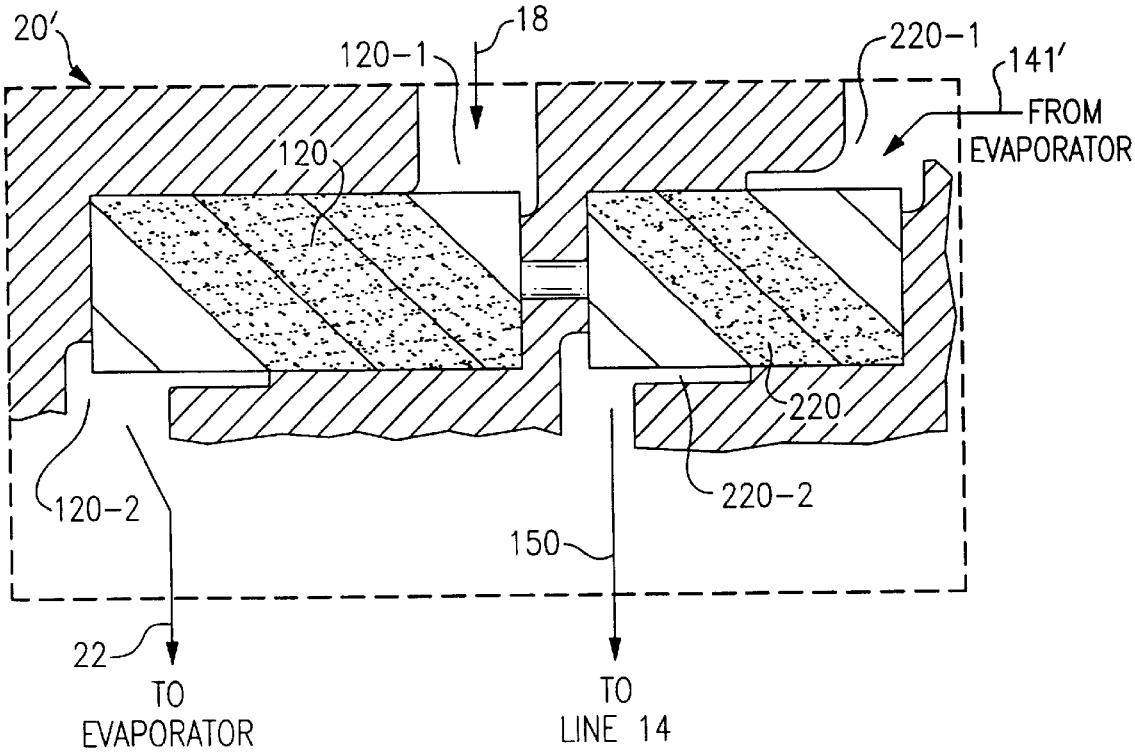
FIG. 7 is a simplified representation of the expressor of the FIG. 6 system.

Referring to FIGS. 6 and 7, system 10' and expressor 20' differ from system 10 and expresser 20 of FIGS. 1–5 in the elimination of separator 140 and lines 130 and 141. Because separator 140 is eliminated, the suction inlet 220-1 is fed from either evaporator 24 or from line 26 just downstream of evaporator 24 via line 141'. Both line 141 and line 141' would be supplying refrigerant vapor at, nominally evaporator pressure. Other than eliminating the separator 140 and its function, the operation of systems 10 and 10' and expressors 20 and 20' are essentially identical.

Although preferred embodiments of the present invention have been illustrated and described, other changes will occur to those skilled in the art. It is therefore intended that the scope of the present invention is to be limited only by the scope of the appended claims.

What is claimed is:

1. A closed refrigeration system containing refrigerant and serially including a main compressor, a discharge line, a condenser, an expressor, an evaporator and a suction line wherein:

said expressor includes a screw expander having a pair of rotors each having a pair of ends and a screw compressor having a pair of rotors each having a pair of ends with each rotor of said screw expander having a common shaft with a corresponding one of said rotors of said screw compressor;

said screw expander and said screw compressor each having an inlet port and an outlet port with said outlet port of said screw expander and said inlet port of said screw compressor being located at first opposing ends of said rotors of said screw expander and said screw compressor respectively;

said outlet port of said screw expander connected to said evaporator;

means for supplying refrigerant vapor at evaporator pressure to said inlet port of said screw compressor;

said inlet port of said screw expander and said outlet port of said screw compressor being located at second opposing ends of said rotors of said screw expander and said screw compressor, respectively;

said inlet port of said screw expander is connected to said condenser;

said outlet port of said screw compressor is connected to said discharge line.

2. The closed refrigeration system of claim 1 wherein said rotors of said screw compressor have a clearance such that said rotors of said screw expander act as timing gears with respect to said rotors of said screw compressor.

3. The closed refrigeration system of claim 1 wherein said separator separates liquid and vapor phase refrigerant and supplies at least 5% of the refrigerant in the vapor phase to said screw compressor for delivery to said discharge line.

4. The closed refrigeration system of claim 1 wherein said first opposing ends of said rotors are at extreme ends and said second opposing ends are at proximate ends.

5. A closed refrigeration system containing refrigerant and serially including a main compressor, a discharge line, a condenser, an expressor, an evaporator and a suction line wherein:

said expressor includes a screw expander having a pair of rotors each having a pair of ends and a screw compressor having a pair of rotors each having a pair of ends with each rotor of said screw expander having a common shaft with a corresponding one of said rotors of said screw compressor;

said screw expander and said screw compressor each having an inlet port and an outlet port with said outlet port of said screw expander and said inlet port of said screw compressor being located at first opposing ends of said rotors of said screw expander and said screw compressor respectively;

a separator;

said outlet port of said screw expander connected to said inlet port of said screw compressor and to said evaporator through said separator;

said inlet port of said screw expander and said outlet port of said screw compressor being located at second opposing ends of said rotors of said screw expander and said screw compressor, respectively;

said inlet port of said screw expander is connected to said condenser;

said outlet port of said screw compressor is connected to said discharge line.

6. The closed refrigeration system of claim 5 wherein said rotors of said screw compressor have a clearance such that said rotors of said screw expander act as timing gears with respect to said rotors of said screw compressor.

7. The closed refrigeration system of claim 5 wherein said separator separates liquid and vapor phase refrigerant and supplies at least 5% of the refrigerant in the vapor phase to said screw compressor for delivery to said discharge line.

8. The closed refrigeration system of claim 5 wherein said first opposing ends of said rotors are at extreme ends and said second opposing ends are at proximate ends.

* * * * *